US010047531B2

(12) United States Patent
Rogers

(10) Patent No.: US 10,047,531 B2
(45) Date of Patent: Aug. 14, 2018

(54) CUP CONNECTOR FOR SCAFFOLD

(71) Applicant: ATHOS CONSTRUCTION PRODUCTS INC., Toronto (CA)

(72) Inventor: Peter J. Rogers, Marietta, GA (US)

(73) Assignee: Athos Construction Products Inc.

( * ) Notice: Subject to any disclaimer, the term of this patent is extended or adjusted under 35 U.S.C. 154(b) by 0 days.

(21) Appl. No.: 15/181,081

(22) Filed: Jun. 13, 2016

(65) Prior Publication Data

US 2016/0281375 A1 Sep. 29, 2016

Related U.S. Application Data

(63) Continuation of application No. PCT/CA2014/000878, filed on Dec. 11, 2014.

(30) Foreign Application Priority Data

Dec. 12, 2013 (CA) ..... 2836564

(51) Int. Cl.

| | |
|---|---|
| ***E04G 5/16*** | (2006.01) |
| ***A62B 5/00*** | (2006.01) |
| ***E04G 7/30*** | (2006.01) |
| ***E04G 7/34*** | (2006.01) |

(52) U.S. Cl.

CPC ..... *E04G 5/16* (2013.01); *A62B 5/00* (2013.01); *E04G 7/302* (2013.01); *E04G 7/307* (2013.01); *E04G 7/34* (2013.01)

(58) Field of Classification Search

CPC ..... E04G 5/16; E04G 7/302; E04G 7/307; E04G 7/34

See application file for complete search history.

(56) References Cited

U.S. PATENT DOCUMENTS

| | | | | |
|---|---|---|---|---|
| 5,894,909 | A * | 4/1999 | Cornish | E04G 1/154 182/119 |
| 5,918,700 | A * | 7/1999 | Gregory | E04G 1/154 182/119 |
| 2002/0079165 | A1* | 6/2002 | Wolfe | E04G 5/10 182/186.7 |
| 2002/0094228 | A1* | 7/2002 | Krauss | F16D 1/087 403/84 |
| 2014/0321908 | A1* | 10/2014 | Brinkmann | E04G 1/12 403/361 |

* cited by examiner

*Primary Examiner* — Alvin C Chin-Shue

(57) ABSTRACT

A cup lock connection system for scaffold equipment advantageously has a locating arrangement for aligning ledgers, braces and other components on the cup lock at predetermined angular positions relative to the scaffold upright. The connecting ledgers, braces and other components preferably have a connecting head receivable on the cup lock connection in one of two orientations. In one orientation the aligning feature is active. In the second orientation the connection can be made without using the alignment functionality.

6 Claims, 14 Drawing Sheets

CUP CONNECTOR FOR SCAFFOLD

FIELD OF THE INVENTION

The present invention relates to scaffold connectors and in particular to a cup type scaffold connector that includes a locating arrangement for selectively maintaining a particular position of a scaffold component on a cup type connector.

BACKGROUND OF THE INVENTION

A cup type scaffolding connector was first introduced by Scaffolding Great Britain Ltd. (SGB) in about 1975. This cup type connector was widely accepted and in recent years a number of similar cup connectors have been introduced. The cup type connector includes a bottom cup that initially was designed to receive up to four members at various positions about a scaffold tube. Each of the connecting members included an end configuration designed to be received, in the bottom cup and to abut with like connecting members if all four members are present. A similar top cup is movable downwardly to engage an upper end of the connectors and further secure the connectors to the leg. The top cup typically has a screw type arrangement for forcing top cup downwardly trapping and pressing down on the ends of the connectors.

After a number of years, a modified system was introduced that allowed eight members to be inserted in a single cup connector. This system provided additional advantages with respect to connecting bracing members as well as to connecting members at different angles when the scaffold legs were positioned in a non rectilinear manner.

A major problem with cup type systems is that the connectors at the ends of the horizontal members are too wide to allow for 5 or more members to be attached in a single cup connector. Also, if the connectors are made narrower the installation of the scaffold system in a rectilinear pattern of scaffold legs is more difficult. These cup connectors have no provision for fixing the position of the respective horizontal members on the bottom when they are located in the bottom cup. This problem is further compounded when additional connections are possible such as in an eight way cup type system, as there is a great deal of movement if only four connecting members are retained.

The problem with respect to movement of the connecting members on the bottom cup is particularly problematic in higher access scaffolding systems and generally elongate configurations of the assembled scaffold. Movement of the connecting members on the bottom cup increases the possibility of racking of the assembled scaffold, and additional tie points are required to provide the necessary structural stability. These additional tie points increase the cost to both erect the scaffolding system and to dismantle the scaffolding system and can lead to installation errors.

Movement of the connecting members that are received in the cap lock is more problematic when there is considerable space between the individual connectors. For example, the cup lock is designed to receive up to eight connecting members however in most cases eight connecting members are not required. This leaves considerable space between adjacent connecting heads of the connecting members and the potential of undesirable movement.

One desirable feature of the cup lock system is the ability of a component to be placed in the cup lock essentially at any angular position. This makes the system easy to assemble adjacent to non rectilinear structures.

The present invention provides a modified cup lock system that provides additional rigidity of connected components while also providing the convenience of free angular placement of the connecting components in the cup lock.

SUMMARY OF THE INVENTION

A scaffold post according to the present invention has a plurality of connection points at predetermined locations intermediate a length thereof. Each connection point comprises a cup connector secured to the scaffold post with a lower peripheral rim spaced outwardly of the scaffold post with a downwardly and inwardly extending intermediate wall connecting the peripheral rim to the scaffold post. The peripheral rim includes, on an upper edge thereof, a plurality of alignment recesses at predetermined angular positions about the circumference of the scaffold post for positioning of a connecting member at a predetermined angular position relative to the scaffold post.

According to an aspect of the invention, each connection point includes a rotatable locking collar above said cup connector for cooperating therewith to secure a ledger head in the cup connector trapped between the rotatable locking collar and the cup connector.

According to a further aspect of the invention, each cup connector includes four alignment recesses preferably positioned at 90 degree intervals, about the circumference of the scaffold post.

In yet a further aspect of the invention the peripheral rim of each connection point is of an inverted U-shape and the alignment recesses are provided through the inverted U-shape.

According to a further aspect of the invention, the alignment recesses are notched regions that preferably define a radially extending slot.

According to yet a further aspect of the invention the peripheral rim includes a support surface inwardly and downwardly of the peripheral rim for engaging connecting members.

In yet a further aspect of the invention a scaffold system comprises a series of scaffold supports as outlined above in combination with a series of ledgers for connecting to the scaffold support post using any of the cup connectors. Each ledger includes a ledger head having an no post engaging face with one end thereof received in the cup connector and an opposite end received in a rotatable inverted locking cup. The ledger head includes a downwardly extending alignment member engageable in any of the alignment recesses to locate the ledger head at a predetermined angular position relative to the scaffold post.

A scaffold system according to a preferred embodiment has ledgers where the ledger heads are reversible with a first horizontal engagement surface having the alignment member and an opposite surface of the ledger head having a flat surface. In this way the ledger in one position can engage and lock with the cup connector at any of the fixed angular positions relative to the scaffolding post and by reversing the ledger head, effectively turning it upside down, the opposite side of the ledger head is received in the cup and is free to assume any angular position or rotate on the rim of the cup as there is no alignment member. The locking collar effectively engages a portion of the ledger head inwardly of the alignment member to trap and secure the ledger head in the cup connector in either the first orientation which allows fixed positioning or the second orientation that allows the ledger head to be positioned on the cup at any angular position and subsequently secured. The alignment member is preferably located outside of the outer edge of the locking collar.

BRIEF DESCRIPTION OF THE DRAWINGS

Preferred embodiments of the invention are shown in the drawings, wherein.

DETAILED DESCRIPTION OF THE PREFERRED EMBODIMENTS

Figure 1:
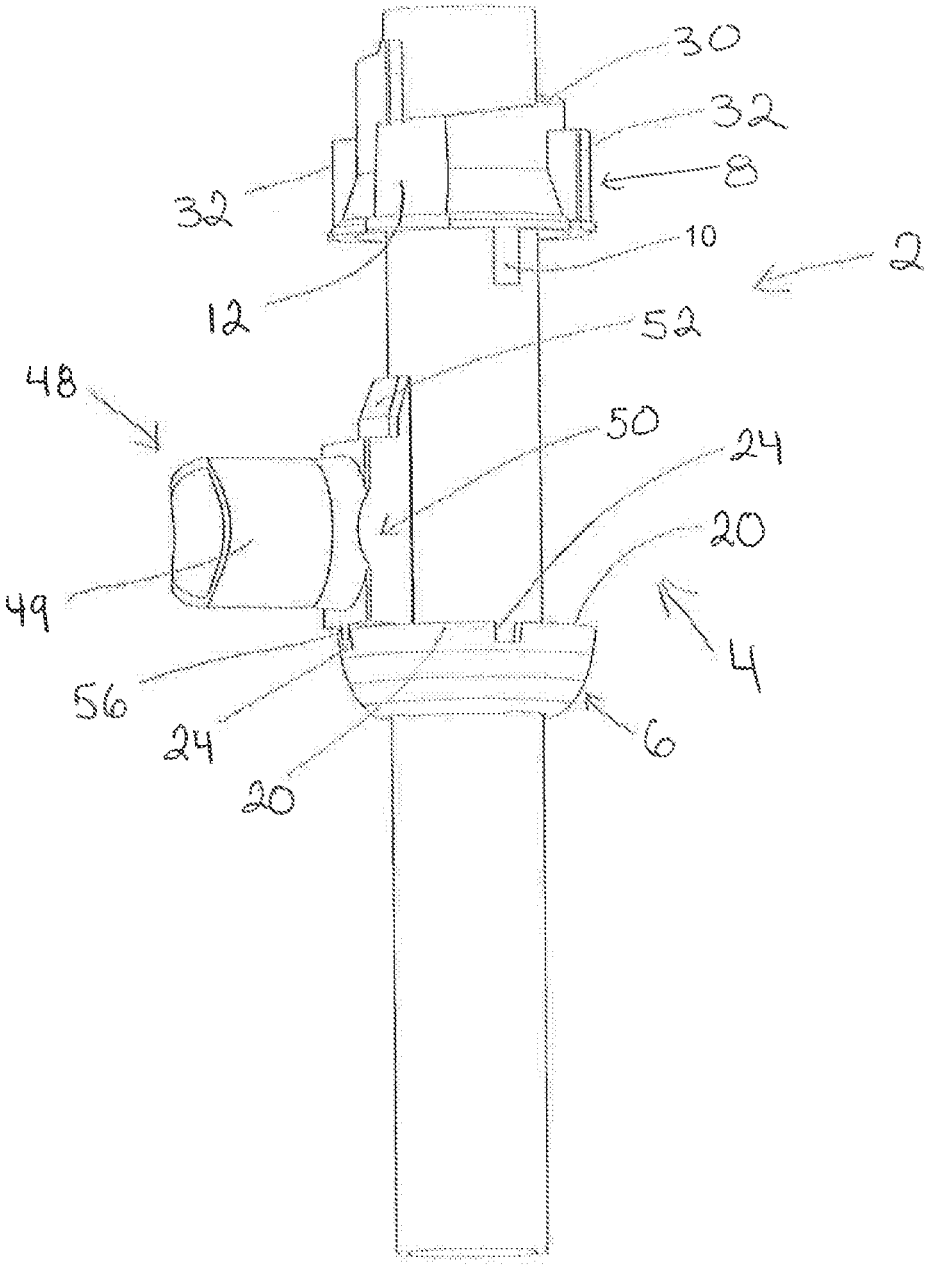
FIG. 1 is a partial perspective view showing a portion of a scaffold post with the modified cup connector.

The scaffold post shown in FIG. 1 is only a portion of a scaffold post 2 as typically the scaffold posts are 6 to 10 feet in length and designed to connect in an end to end manner. A series of connectors are provided at spaced points in the length of the scaffold post that allow horizontal or diagonal connection of adjacent scaffold posts. The present scaffold post uses the cup lock connector 4. The cup lock connector 4 includes a bottom cup 6 that cooperates with a locking top cup 8. The locking top cup 8 has been moved to a top clear position as the welded stop 10 is positioned below the top cup 8 and the top cup is vertically separated to provide clearance above the bottom cup that simplifies insertion of connecting members such as the ledger 48 during scaffold erection. The ledger 48 includes a ledger head 50 having a lower portion 51 that is received in the bottom cup 6 such that the ledger head 50 presses against the vertical surface of the scaffold post.

As shown in FIG. 1, the ledger head 50 includes a downwardly extending aligning projection 56 that is receivable in any of a series of aligning recesses 24 provided in an upper surface of the bottom cup 6. The aligning recesses are sized to receive the aligning projection and basically fix the angular position of the ledger head or other component relative to a vertical axis of the scaffold post 2. Four alignment recesses 90° apart are provided and all cup connectors of a scaffold post are aligned. Once the appropriate ledger heads have been supported in the bottom cup 6, the locking top cup 8 can be moved downwardly to engage the upper portion 52 of the ledger heads 50 as they are received within a downwardly opening cavity 61 of the locking top cup. The locking top cup is driven downwardly by rotating the locking top cup causing the screw thread track 30 to engage with the bottom surface of the weld stop 10. The weld stop 10 can pass through the top cup 8 when aligned with the stop passage 12 and the top cup is moved upwardly. Basically for locking of a ledger in a first orientation thereof, shown in FIG. 1, the top cup 8 is rotated about the scaffold post and the top cup is forced downwardly to engage the angled top surface 52 of the ledger head and maintains the ledger head in the bottom cup and in abutment with the scaffold post.

Figure 2:
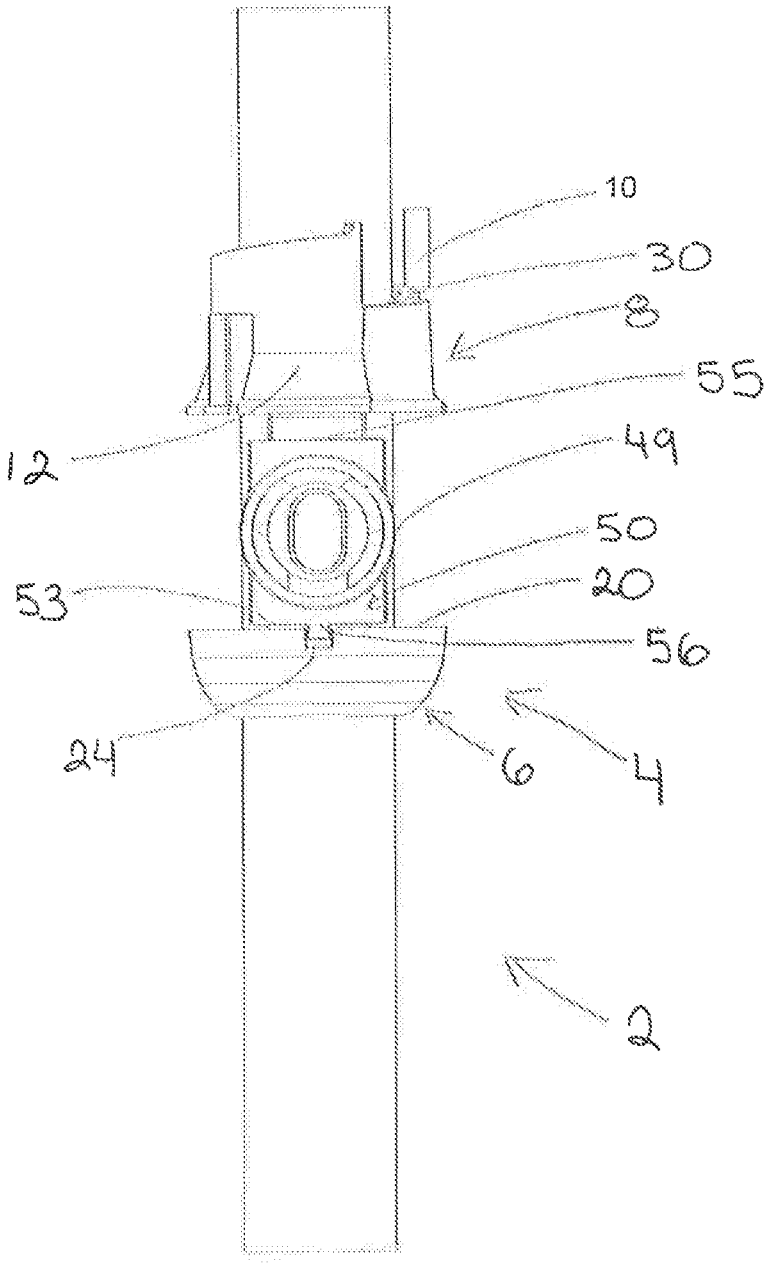
FIG. 2 is a vertical view showing a ledger connected to the scaffold post.

In FIG. 2 it can be seen that the ledger head 50 has the aligning projection 56 received in an aligning recess 24 and thus the ledger head 50 cannot rotate about the vertical axis of the scaffold post. The locking top cup 8 has been forced downwardly and restricts any upward movement of the ledger head 50 such that the ledger head 50 is now trapped between the locking top cup 8 and the bottom cup 6 and engages the scaffold post. This is first orientation of the ledger which is received in predetermined angular positions determined by the aligning recesses 24 and the aligning projections 56.

As shown in FIGS. 1 and 2, the ledger head 50 preferably connects with a bracing member 49 shown as a cylindrical tube that is welded or otherwise secured to the ledger head 50 for forming the fixed length ledger 48. The overall height of the ledger head is such that it engages an extended vertical surface of the scaffold post 2 to effectively distribute horizontal loads that this member exerts on the scaffold post. By increasing the height of the ledger head the width of the ledger head can be reduced. Vertical loading is through the bottom cup.

Figure 3:
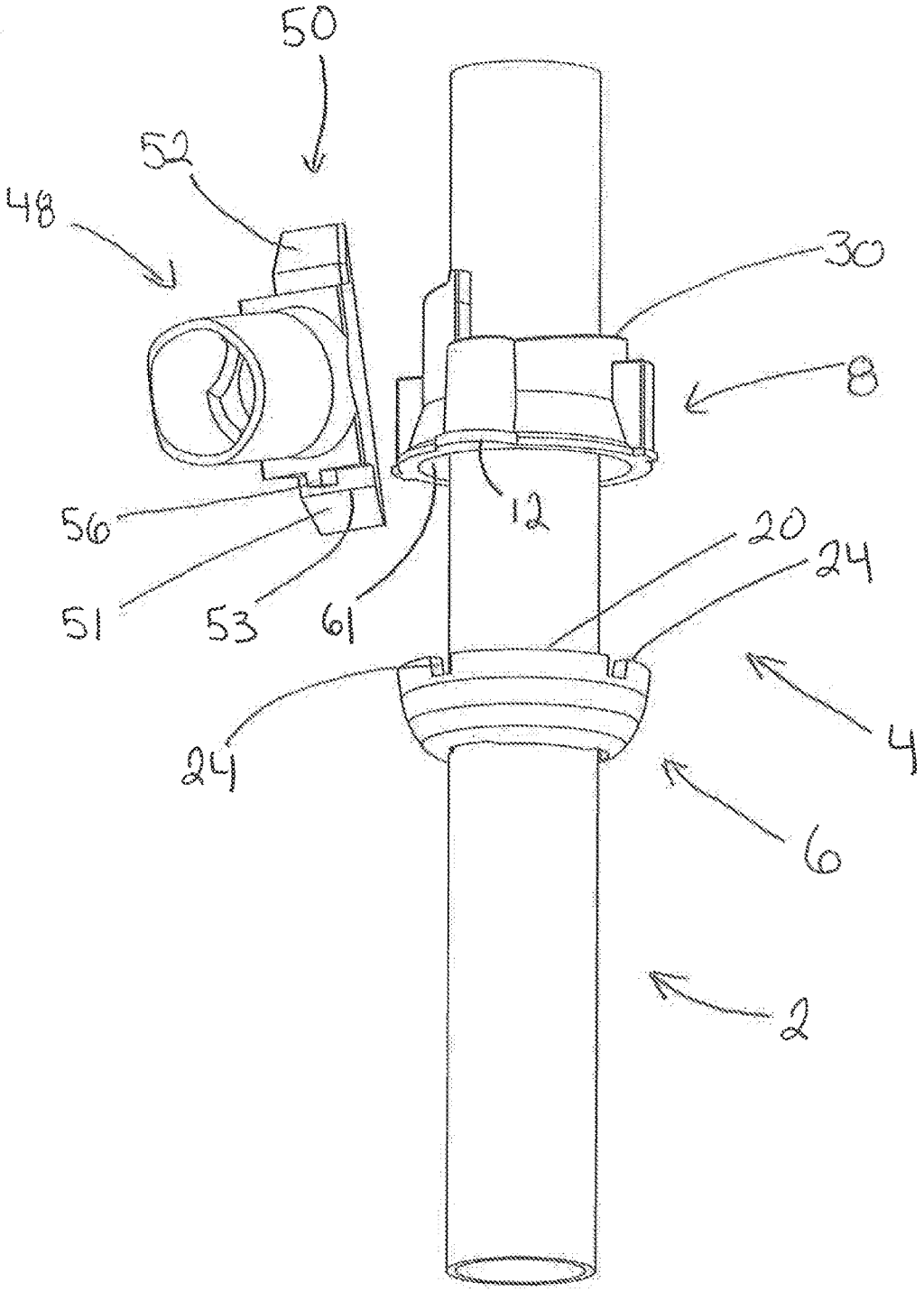
FIG. 3 is a partial perspective view showing the initial insertion of a ledger in a cup connector.
Figure 4:
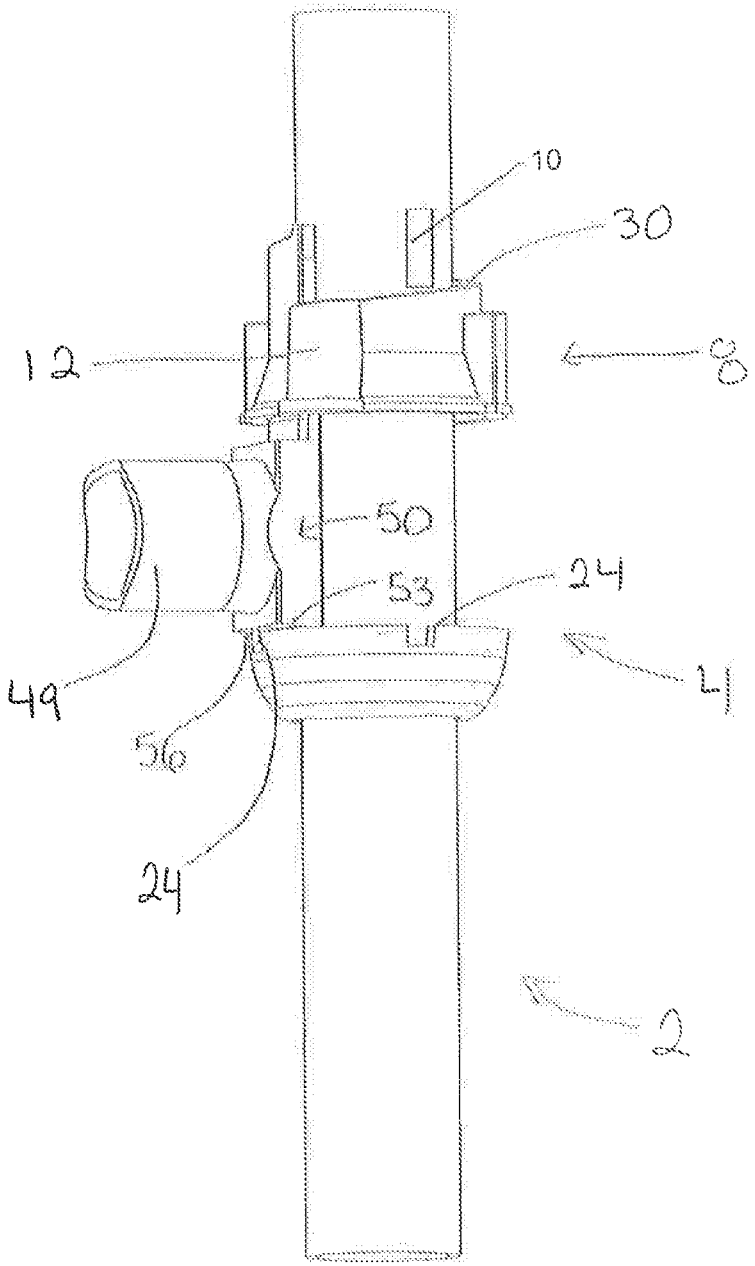
FIG. 4 is a partial perspective view showing a ledger head connected to the cup connector and locked with respect to horizontal movement about the cup connector.

FIGS. 3 and 4 show the initial insertion of the ledger head 50 in the bottom cup 6 and the alignment of the ledger head 50 on the scaffold post 2 as the aligning projection 56 is received in the aligning recess 24 of the bottom cup. As illustrated in FIG. 4, the locking top cup 8 engages the top portion 52 of the ledger head forcing the ledger head 50 downwardly into the bottom cup and retained therein. The bottom surface of the ledger head 50 includes a projecting flange 53 that engages the peripheral rim 20 of the bottom cup 6 to further distribute the load to the bottom cup.

Figure 5:
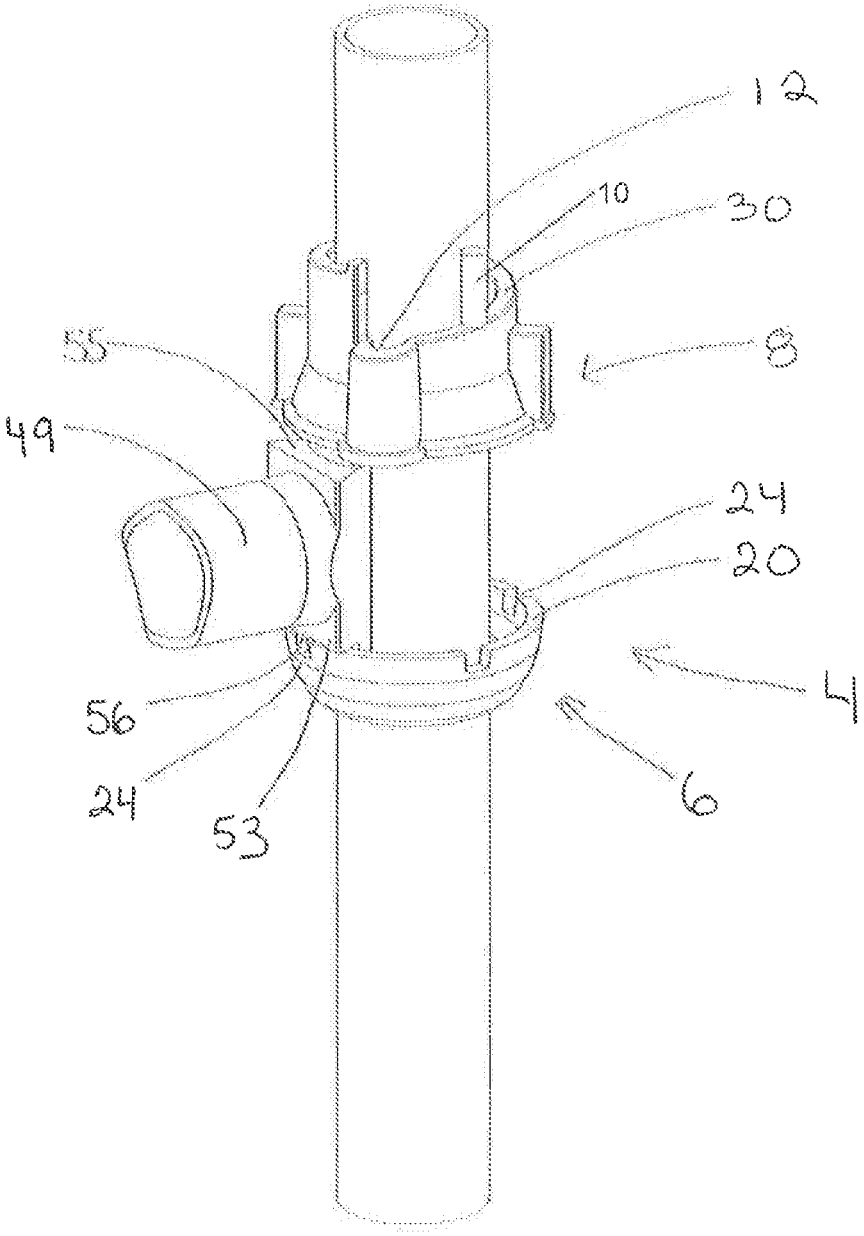
FIG. 5 is a perspective view similar to FIG. 4.

FIG. 5 shows a ledger head 50 that is locked on the scaffold post 2 with the locking top cup 8 cooperating with the weld stop 10 to drive the locking top cup 8 downwardly by rotation of the top cup about the scaffold post, in this case in a clockwise direction.

Figure 6:
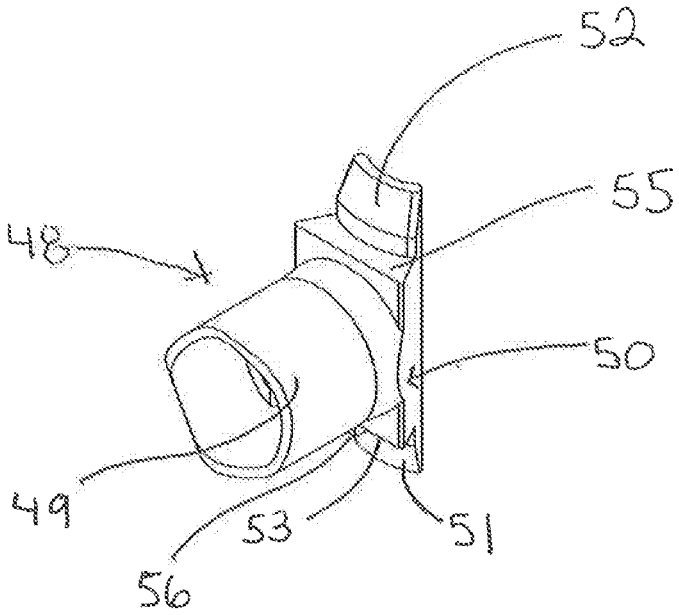
FIG. 6 is a partial perspective view of a ledger and ledger head.
Figure 7:
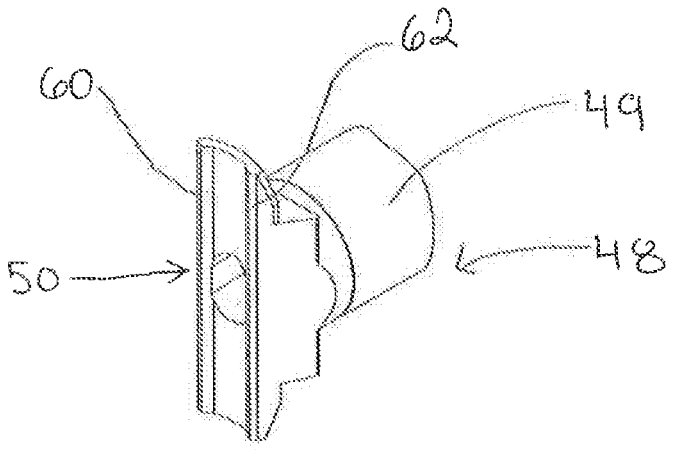
FIG. 7 is a partial perspective view showing the ledger head and the surfaces for engaging the scaffold post.

FIG. 6 shows the ledger head 50 in a locking type orientation as the aligning projection 56 is facing downwardly for receipt in an aligning recess 24 of the bottom cup 6. The locking top cup 8 has an interior surface that effectively engages the upper portion 52 of the ledger head 50. The ledger head in horizontal plan view narrows (tapers inwardly) toward the end thereof to allow additional space for other components to engage the bottom cup. FIG. 7 shows the ledger head 50 from the other direction and it can be seen that the ledger head includes two vertical ribs 60 and 62 that engage the scaffold post. These ribs distribute the load of the ledger 48 to a larger vertical section of the scaffold post.

Figure 8:
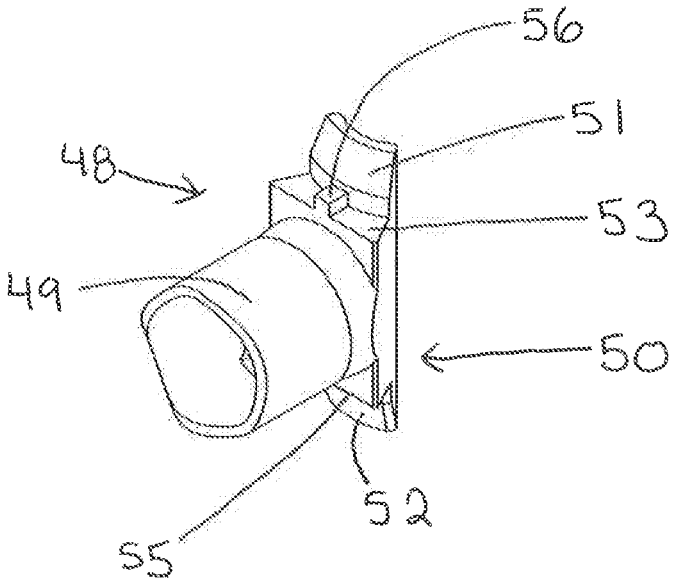
FIG. 8 is a partial perspective view of a ledger and ledger head in a reverse orientation allowing movement about the cup connector.
Figure 9:
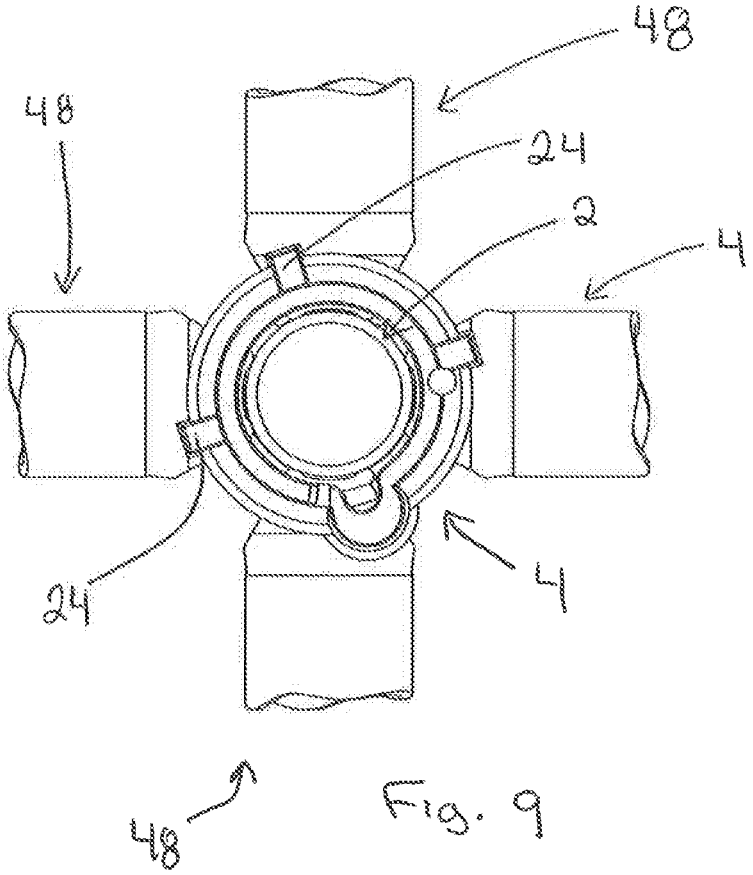
FIG. 9 is a top view of the cup connector securing four ledgers.

FIG. 8 shows a reverse or second orientation of the ledger 48 with the ledger head 50 having the aligning projection 56 facing upwardly. As can be seen, the angled lower portion 51 that was received and cooperates with the bottom cup 6 is now facing upwardly and provides the appropriate surface for engaging the downwardly opening support surface 61 of the top cup 8. The aligning projection 56 is positioned downwardly of the surface 51 such that the locking top cup is free to rotate without interference from the aligning projection 56 as shown in FIG. 10.

Figure 10:
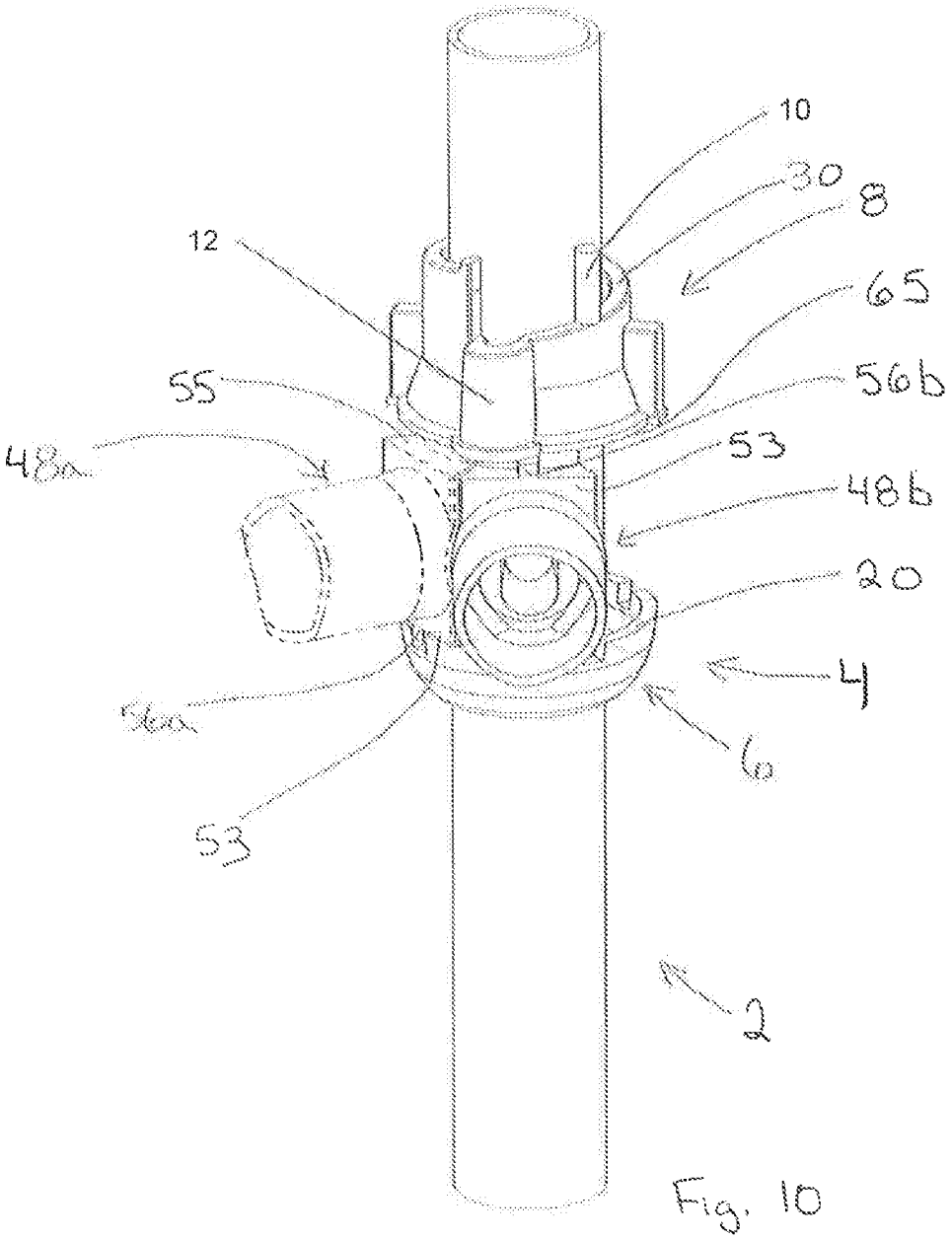
FIG. 10 is a partial perspective view showing a first ledger head in dotted lines in locking engagement with a cup connector and a second ledger head in abutment therewith where the ledger head has a reverse orientation.

The aligning projection 56*b* of ledger 48*b*, shown in FIG. 10, faces upwardly and is located downwardly of the lower edge 65 of the locking top cup 8. In FIG. 10 one ledger 48*a* is shown with a locking projection 56*a* engaging the bottom cup 6 (first orientation of ledger). The ledger 48*b* has been rotated 180° such that the aligning projection 56*b* faces upwardly (second orientation of ledger). The bottom surface of the ledger 48*b* is appropriately received in the bottom cup 6 in a manner essentially identical to receipt of the ledger head with the projection aligned with the recess, however there is no aligning projection and as such the ledger head can be placed at any position on the peripheral rim 20 of the bottom cup 6.

Figure 11:
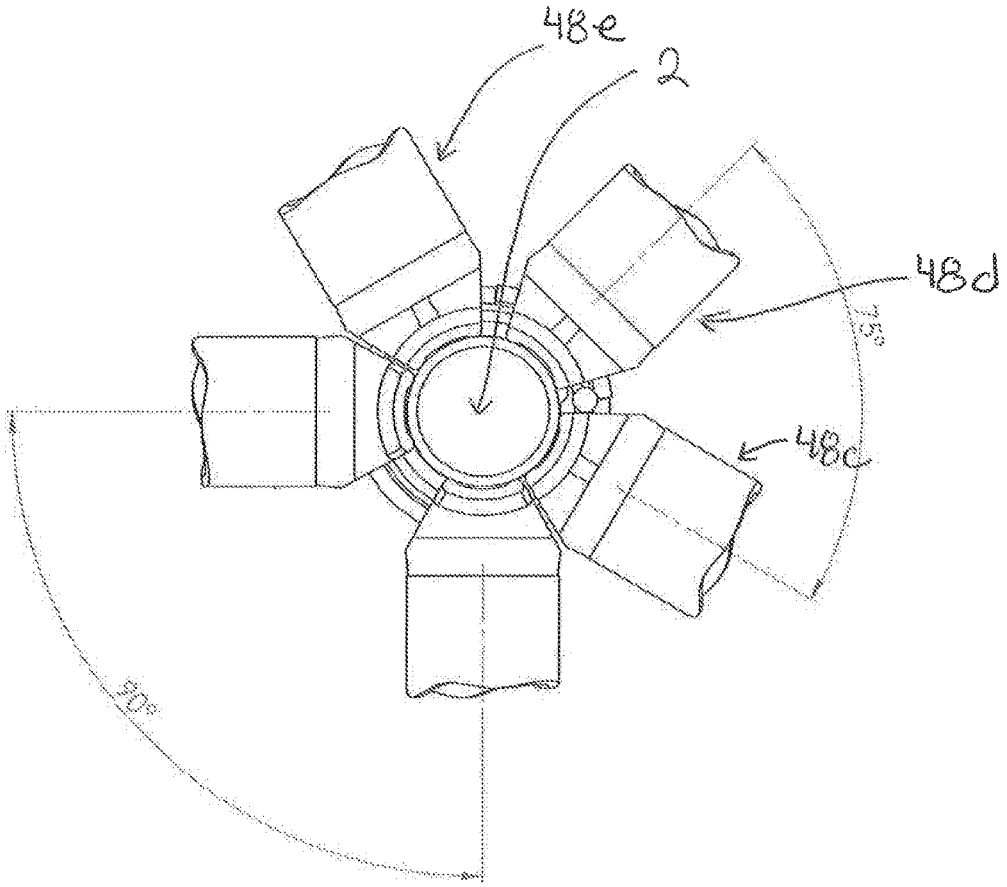
FIG. 11 is a top view showing two aligned ledger heads engaging a cup connector of a scaffold post and in registration therewith and three other ledger heads at different angular positions secured in the cup connector.

As shown in FIG. 11, two ledger heads are positioned at a 90° angular placement relative to the scaffold post 2 and these two ledger heads have aligning projections received in appropriate aligning recesses 24 in the bottom cup 6. Three further ledger heads 48*c*, 48*d* and 48*e* are shown and their aligning projections 56 face upwardly. These ledger heads have been placed at a non 90° angular position in the bottom cup and two of these ledger heads (i.e. 48*c* and 48*e*) are in general abutment with the locked ledger heads (48*a* and 48*b*) while ledger 48*d* is positioned at an unrelated angular position. Basically if the ledger heads are turned to the non-locking orientation (i.e. the aligning projections face upwardly) the ledgers may be placed at any angular position in the bottom cup 6 and the position is only limited by other components placed in the bottom cup 6. As clearly indicated in FIG. 11, some of the ledger heads can be locked relative to the cup and other ledger heads can be located without locking at unrelated positions. It can be appreciated that any mixture of locked and unlocked connection members can be used.

As shown in FIG. 6, the ledger head 50 includes outwardly extending flange surfaces 53 and 55. One of these flange surfaces engage the peripheral rim 20 of a bottom cup when a ledger head is received in the bottom cup and reverse when the ledger head is reversed from a locked orientation of FIG. 1 to a non-locked position (ledger 48*b* in FIG. 10). These surfaces provide better engagement and load distribution to the bottom cup 6. Note in the locked position of FIG. 2, flange surface 55 is spaced downwardly out of contact with the locking top cup 8. Similarly, flange surface 53 is spaced downwardly out of contact with the locking top cup 8 as shown in FIG. 10.

Figure 12:
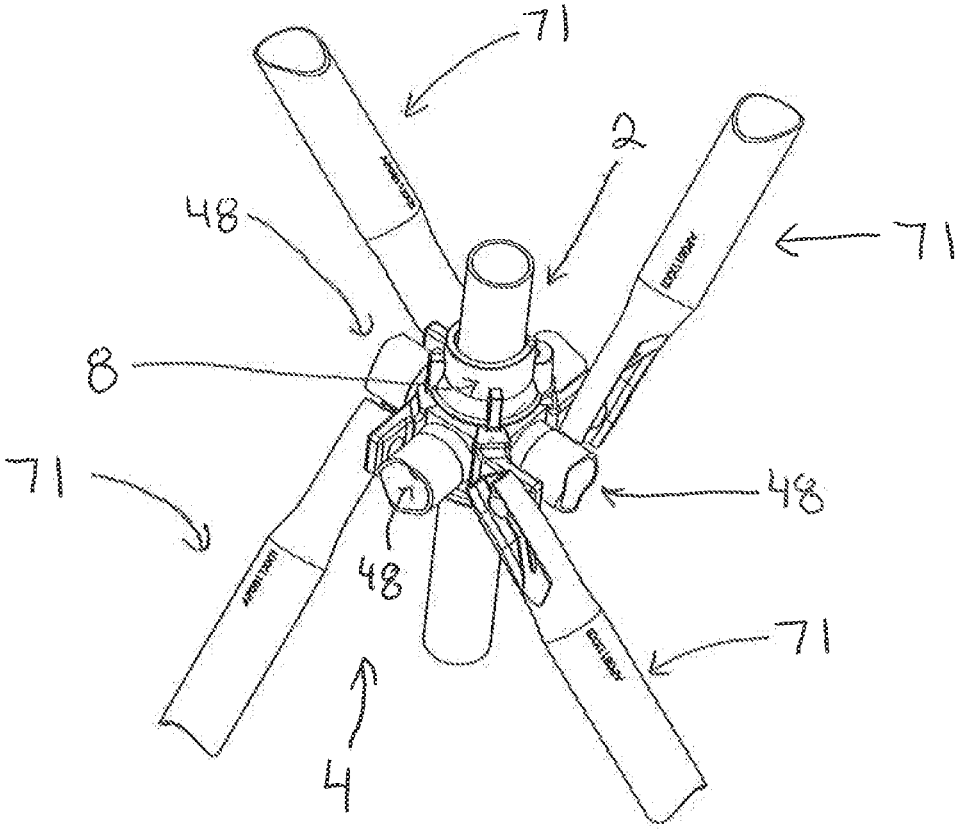
FIG. 12 is a partial perspective view showing four ledger heads connected to the cup connector and four bracing members connected to the cup member between adjacent ledgers.
Figure 13:
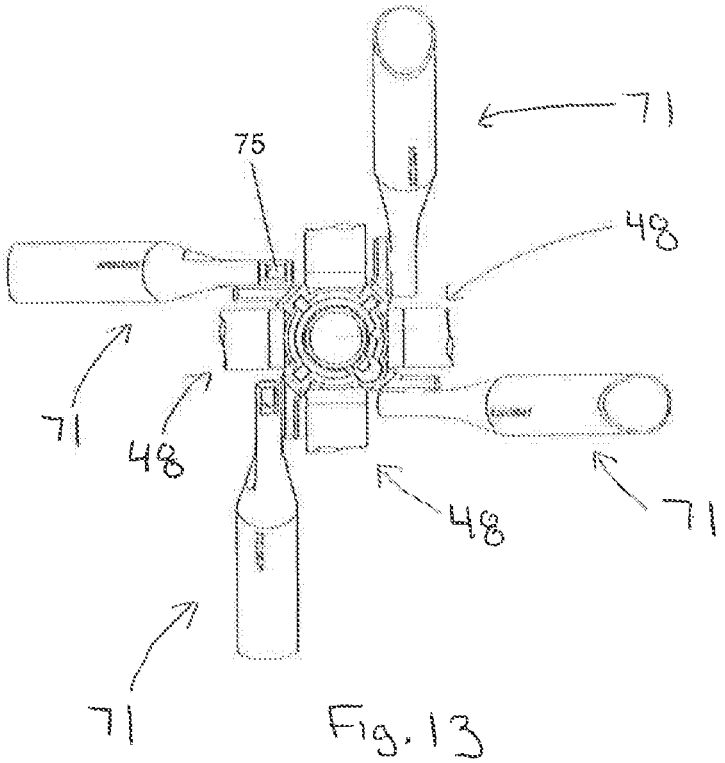
FIG. 13 is a top view similar to the components of FIG. 12.
Figure 14:
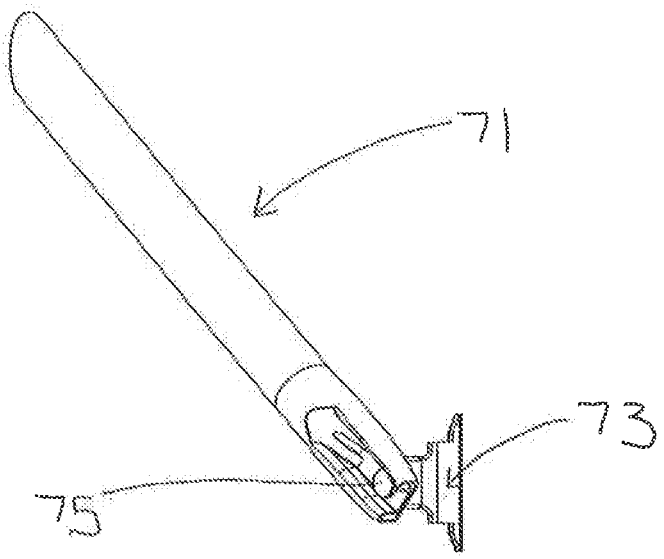
FIG. 14 is a partial perspective view of a brace connector.
Figure 15:
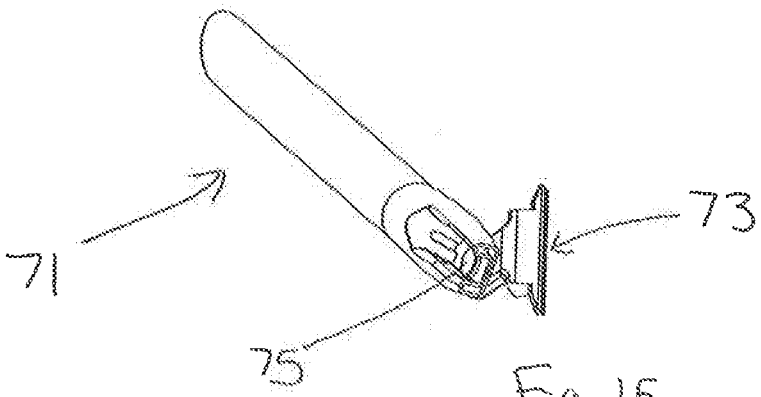
FIG. 15 is a partial perspective view of a brace connector where the brace is at a different angle.

A further embodiment of the invention is shown in FIG. 12 where the cup lock connector 4 receives four ledger heads in an aligned locked position and four bracing members received in the cup lock in the gap between adjacent locked ledger heads. The size of the ledger heads for the brace members 71 is smaller and is designed to fit between locked adjacent ledger heads. Basically the load exerted on the scaffold post by a ledger is greater than the load typically exerted by ledgers 48 that are cross brace ledgers.

One of the advantages of the arrangement shown in FIG. 12 is that both the diagonal brace members 71 and the ledgers 48, use cylindrical tubing as the elongate component connecting ledger heads at opposite ends of the tubing. Cylindrical tubing provides good structural characteristics and is readily available and cost effective. As illustrated in FIG. 12, the tubing of the diagonal brace members has been deformed and flattened narrowing the width of the cylindrical tubing at the ends thereof to accommodate a preferred pivot connection 75 with a smaller connecting head 73. The pivoting on the ledger head allows them to be more easily inserted in the bottom cups.

In the preferred embodiments the bottom cup 6 includes four aligning recesses spaced 90° from each other to assist in connecting of adjacent scaffold posts in a rectilinear manner. Ledger heads are locked in the cups and the particular angular space of 90° ensures that the overall system of connected scaffold posts remains generally perpendicular in a horizontal plan view. Additional locking recesses could be provided, however for simplicity with respect to manufacturing as well as with respect to erection of the system four locking recesses are preferred.

The system as shown effectively locks four ledgers or other components at a particular angular orientation in cup lock connectors of a scaffold post. The ledger heads of the ledgers are reversible and in one orientation of the ledger this locking feature engages and lock with an alignment recess of she cup and in a reverse orientation of the ledger it is free to be placed at any angular placement in the bottom cup. Regardless of the orientation of the ledger head the top cup engages the same angled surface at the same position on the scaffold post. The aligning projections are positioned outwardly of an outer peripheral edge of the top cup such that the top cup is free to rotate and act to move downwardly and lock the ledger head in the connection. The system as shown allows up to eight connections to provide effective positive bracing. If eight connections are present the additional four connections are effectively trapped between the previously aligned ledgers. With this arrangement the erected scaffolding is stiff on plan due to the locking of the ledger heads and the ledger heads cannot effectively lock about the bottom cup.

The improved cup lock connection provides advantages with respect to accurate positioning of the ledger heads at predetermined positions on the bottom cup while also allowing the desirable feature of free placement of the ledger heads at a host of different angular positions on bottom cups. There is no requirement to have ledger heads which only one of these functions as the ledger head is reversible and can change from locking to non-locking merely by rotation thereof. The system when used with locked ledger heads has improved load support characteristics and less tie points may be required.

Although various preferred embodiments of the present invention have been described herein in detail, it will be appreciated by those skilled in the art, that variations may be made thereto without departing from the claimed invention.

The invention claimed is:

1. A scaffold system comprising a series of scaffold posts and a series of ledgers with each ledger having opposed ledger heads joined by a longitudinally extending brace member;

each scaffold post comprises a plurality of cup connectors secured to said scaffold post at predetermined locations intermediate a length thereof;

each cup connector including a bottom cup and a rotatable downwardly opening top cup, said bottom cup having an upwardly facing peripheral rim separated from and spaced outwardly of said scaffold post and a downwardly and inwardly extending intermediate wall connecting said peripheral rim to said scaffold post;

said peripheral rim including on an upper edge thereof, a plurality of alignment recesses at predetermined angular positions about the circumference of said scaffold post;

said ledgers being connectible to any of said cup connectors with said opposed ledger heads of each ledger being receivable in any of said bottom cups in both a first orientation and a second orientation of the ledger;

each ledger head in said first orientation of the ledger includes an alignment member receivable in any of said alignment recesses to locate the ledger relative to the scaffold post at one of said predetermined angular positions;

each ledger head in said second orientation of the ledger being receivable in any of said bottom cups with said alignment member separated from the peripheral rim allowing the ledger head to be located at various angular positions relative to the scaffold post in addition to said predetermined angular positions; wherein each ledger head in said first and second orientation includes an outwardly extending support surface positioned to engage and be supported by said peripheral rim of any of said cup connectors when received therein; wherein the alignment member of each ledger head in said second orientation is received in one of said downwardly opening top cups with the alignment member positioned outwardly of and below the downwardly opening top cup in a looked position of the downwardly opening top cup.

2. A scaffold system as claimed in claim 1 wherein each ledger head includes scaffold post engaging faces located either sides of said longitudinally extending brace members and each scaffold engaging face is receivable in any of said bottom cups and said downwardly opening top cups.

3. A scaffold system in claim 1 wherein each ledger head includes tapered guide surfaces receivable in said bottom cups and shared to overlap and cooperate therewith in both said first and second orientations of the ledger.

4. A scaffold system as claimed in claim 1 wherein each cup connector includes 4 alignment recesses.

5. A scaffold system as claimed in claim 4 wherein said 4 alignment recesses are positioned at 90° intervals about the circumference of said scaffold post.

6. A scaffold system as claimed in claim 5 wherein said alignment recesses are radially extending slots and each radially extending slot includes a support surface at an inward edge of said peripheral rim and a support surface at an outward edge of said peripheral rim.

* * * * *